United States Patent [19]

Schrader

[11] Patent Number: 4,497,101

[45] Date of Patent: Feb. 5, 1985

[54] METHOD AND APPARATUS FOR THE MANUFACTURE OF A THREE-DIMENSIONAL, SHAPED GRAPHITE ELECTRODE UTILIZING A THREE-DIMENSIONAL, SHAPED FILE

[75] Inventor: Rolf Schrader, Braunschweig, Fed. Rep. of Germany

[73] Assignee: Grafon AG, Oreseline, Switzerland

[21] Appl. No.: 459,538

[22] PCT Filed: Jun. 21, 1982

[86] PCT No.: PCT/CH82/00081

§ 371 Date: Jan. 17, 1983

§ 102(e) Date: Jan. 17, 1983

[87] PCT Pub. No.: WO83/00111

PCT Pub. Date: Jan. 20, 1983

[30] Foreign Application Priority Data

Jun. 27, 1981 [DE] Fed. Rep. of Germany ..... 3125316

[51] Int. Cl.[3] ..... B23D 67/00; B23D 71/00

[52] U.S. Cl. ..... 29/76 R; 29/78; 51/60; 51/157; 51/281 R

[58] Field of Search ..... 51/157, 60, 125, 281 R; 29/76 R, 78; 407/11; 409/136

[56] References Cited

U.S. PATENT DOCUMENTS

| | | | |
|---|---|---|---|
| 3,435,562 | 4/1969 | Maillet | 51/60 |
| 3,465,480 | 9/1969 | Hausermann | 51/157 |
| 4,302,135 | 11/1981 | Lillie | 407/11 |
| 4,322,189 | 3/1982 | Briese | 407/11 |

*Primary Examiner*—Leonidas Vlachos

*Attorney, Agent, or Firm*—Frishauf, Holtz, Goodman & Woodward

[57] ABSTRACT

The invention relates to an apparatus for manufacturing a three-dimensional, shaped graphite electrode (3) utilizing a three-dimensional, shaped file (4), moved toward one another (filing stroke) while executing an orbital relative movement between the shaped file and the three-dimensional, shaped electrode blank until such time as the contour of the three-dimensional, shaped electrode corresponds, with tolerance, to a negative copy of the contour of the shaped file. During the filing process, graphite particles filed off by the shaped file are flushed out of the working gap (7) formed between the shaped file and the three-dimensional, shaped electrode with the aid of a flushing fluid. The shaped file, which has an outer wall (10) pointing upward and surrounding it in pan-like fashion, the upper rim (12) of which is at a higher level than the highest point on the contour of the shaped file, is secured to a work plate (1) or the like executing orbital movements, while the three-dimensional, shaped electrode blank is secured to a ram plate (2) disposed above the work plate.

12 Claims, 4 Drawing Figures

Figure 1:
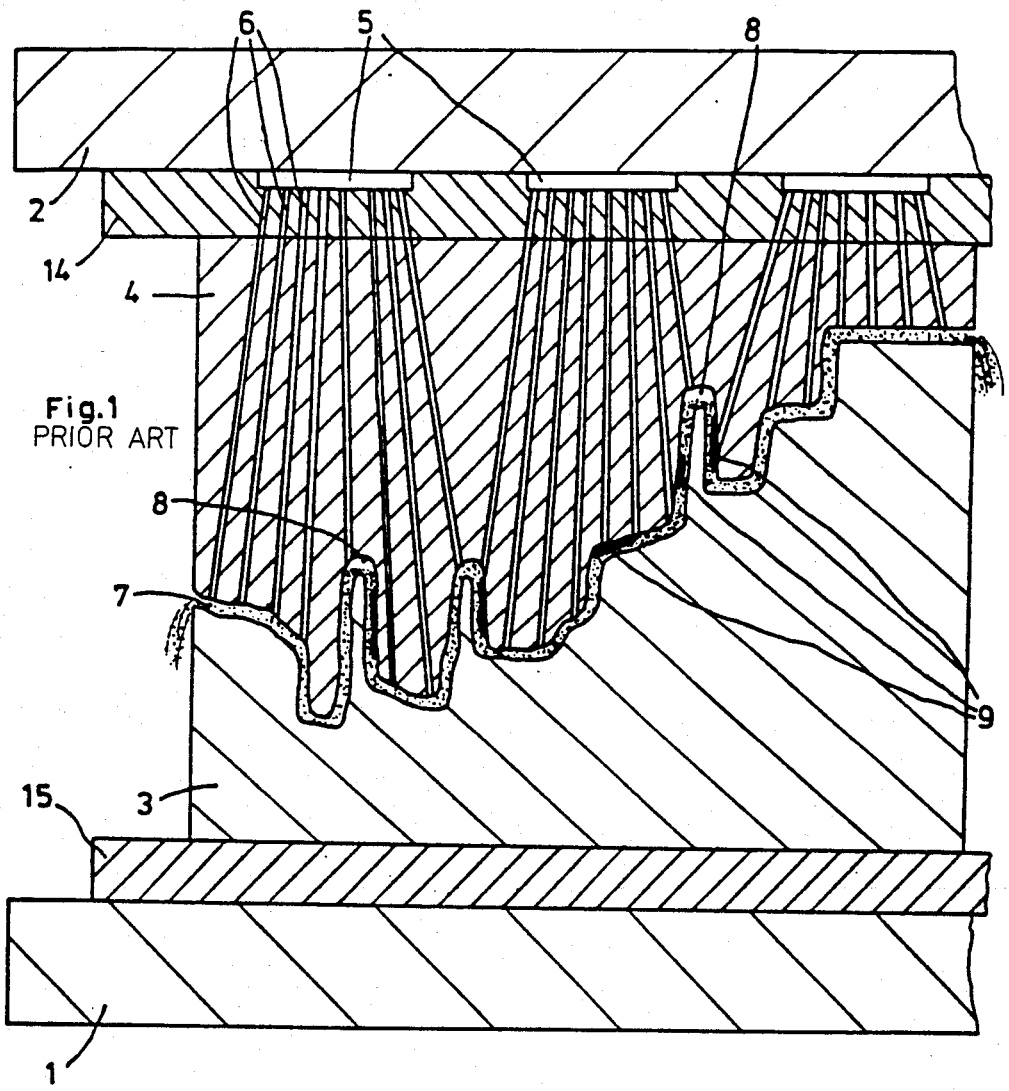
Fig.1 PRIOR ART

METHOD AND APPARATUS FOR THE MANUFACTURE OF A THREE-DIMENSIONAL, SHAPED GRAPHITE ELECTRODE UTILIZING A THREE-DIMENSIONAL, SHAPED FILE

The invention relates to an apparatus for the manufacture of a three-dimensional, shaped graphite electrode utilizing a three-dimensional, shaped file.

BACKGROUND

In machining hollow forms such as those in forging dies or casting molds by spark erosion, three-dimensional, shaped graphite electrodes which are dimensionally accurate are required.

The previously most widespread method for manufacturing three-dimensional, shaped electrodes, that is, copy-milling, not only is very time-consuming but also involves unavoidable inaccuracies of dimension.

Three-dimensional, shaped graphite electrodes can be manufactured much more rapidly and very much more accurately by utilizing shaped files; these are three-dimensional filing tools with a rough filing surface, the shape of which is substantially complementary to the intended shape of the three-dimensional, shaped electrode. These shaped files are generally of plastic which has an abrasive, such as corundum, embedded in it.

According to known shaped-file apparatus, a three-dimensional, shaped electrode blank—that is, a block of graphite that is either unfinished or only rough-finished—is clamped to a work plate or the like, which executes planetary or orbital movements, caused for instance by an eccentric drive mechanism. The shaped file, for its part, is secured to a ram plate or the like and is continuously lowered by the ram plate toward the three-dimensional, shaped electrode blank, so that the intended shape of the three-dimensional, shaped electrode is created gradually by the filing away of the blank. The electrode material removed from the blank during the course of the filing is flushed out of the machining zone—that is, the working gap formed between the shaped file and the blank—by a fluid which is under pressure. To this end, many flushing conduits of comparatively small diameter are disposed in the shaped file, being distributed over its surface in an at least approximately uniform fashion, and discharge into the working gap. The flushing fluid exiting like a shower from the flushing conduits during the course of filing is intended to assure that the small particles of graphite removed during filing are transported out of the gap between the file and the electrode.

In comparison with copy-milling or other chip-removing machining processes, this manufacturing method represents significant progress in terms of expended time, accuracy and economy.

To assure that work will proceed without malfunctions and that it is accurate to size, it is very important for the graphite particles that are created to be transported continuously and completely out of the working gap; otherwise a sticky buildup may occur at various points on the shaped file, resulting in the breakage of the shaping file or of the three-dimensional, shaped electrode. Particularly when producing complicated shapes that are relatively heavily ribbed, this known manufacturing method is associated with the frequent formation of such sticky buildups; among other reasons, this is becasue it is very difficult to dispose the many flushing conduits at just the truly critical locations on the contour of the shaped file. For instance, 120 flushing conduits with a diameter of 2 mm are required on an average for an average shaped file, for instance one which is approximately 350×350 mm in size. In order to produce these flushing conduits, a corresponding number of bores of that diameter are drilled in the pattern mold for manufacturing the shaped file; nails or pins are hammered into the bores and then protrude upward out of the pattern mold. Plastic tubes are then pushed onto these pins, the tubes later forming the flushing conduits. A coating of a mixture of plastic and lubricant is then applied, carefully and without any bubbles, to the thus-prepared pattern mold; because of the high number of flexible tubes, this is difficult and time-consuming. After back-filling and then casting with an adapter plate or the like, the shaped file can be unmolded from the pattern mold, in the course of which damage may occur to the file or to the mold, if the nails or pins driven into the mold are not sufficiently perpendicular. Before use, the filing surface of the shaped file that has been removed from the pattern mold must be sharpened in a jet blower using glass powder or the like, in the course of which some of the many flushing conduits generally become plugged with glass powder or plastic dust. The danger that some of the plugged flushing conduits may not be reopened sufficiently well cannot be entirely precluded.

THE INVENTION

It is an object to further improve apparatus of this type, and in particular to so construct the filing tool that on the one hand the filing action is improved because of the elimination of or at least sharp reduction in the formation of sticky buildup, and on the other hand the expenditure for manufacturing the shaped file itself is simultaneously reduced sharply.

Briefly, the three-dimensional file is located on a support plate, for example carrying out an orbital movement. Flushing fluid ducts, of which only very few are needed, and, for some shapes only a single one may be sufficient, are so connected that the flushing fluid ducts terminate at the lowest point of the contour of the file. The file is, additionally, surrounded by an outer wall which is higher than the highest point of the contour. In operation, flushing fluid is introduced into the gap formed upon reciprocating movement between the electrode blank or block, which is held in a reciprocatable holding or slider plate above the file, and the contour of the file, the flushing fluid being introduced, as has been noted, always at the lowest point, although it may be introduced at some other points as well, and being constrained to flush out over the lateral walls of the file.

DRAWINGS

Figure 2:
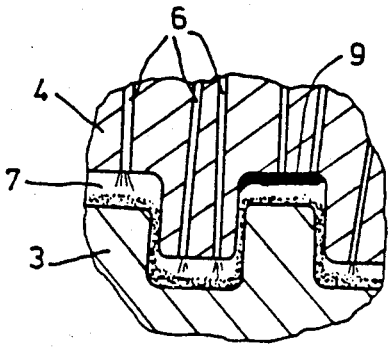
Fig. 2 PRIOR ART
Figure 3:
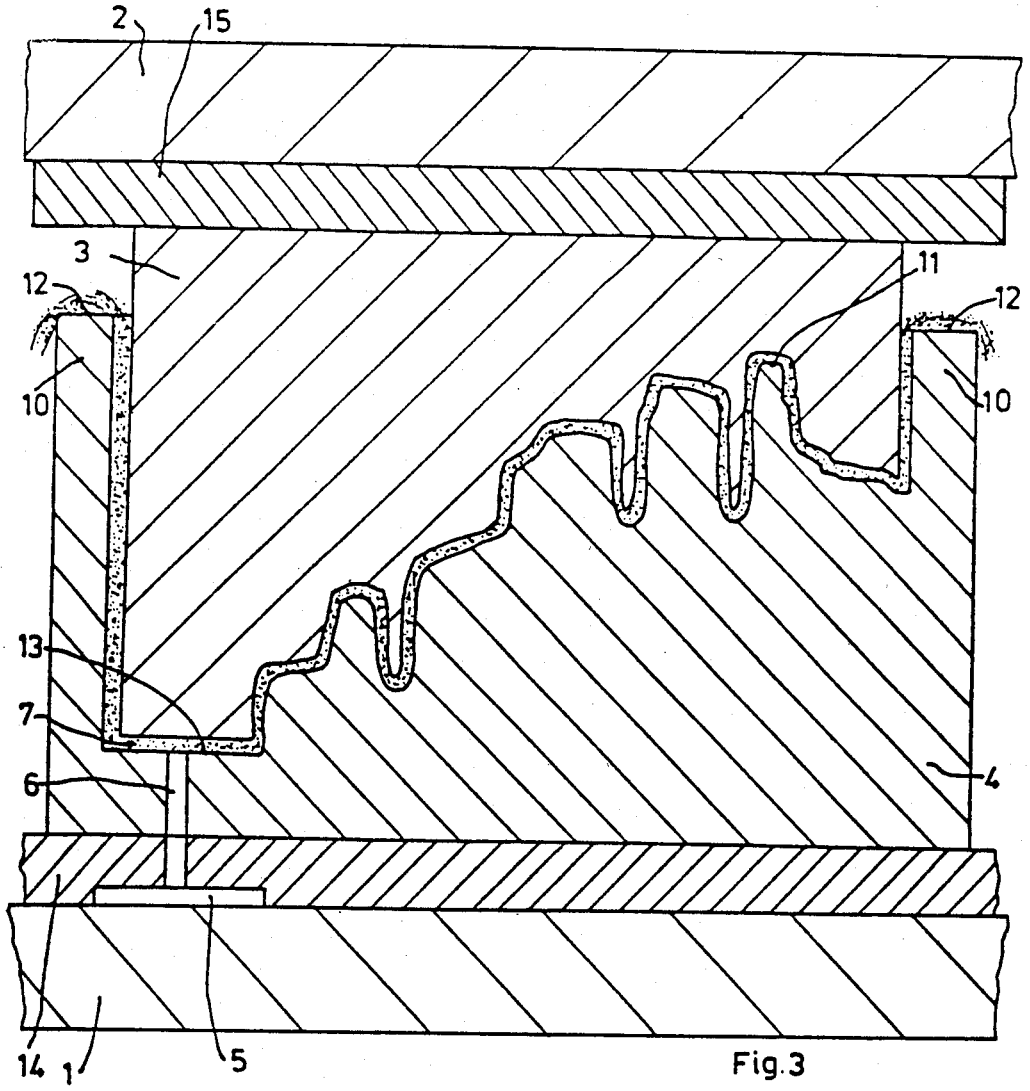

Shown in the schematic drawing are:

FIG. 1, an apparatus as found in the prior art;

FIG. 2, a detail of this known apparatus;

FIG. 3, an apparatus according to the invention; and

Figure 4:
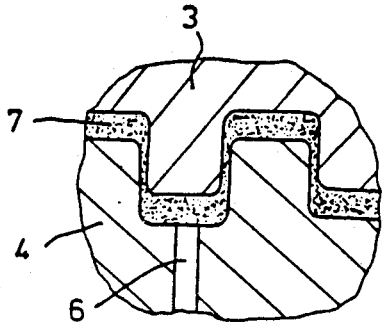

FIG. 4, a detail of the apparatus according to the invention.

The only details of an apparatus for the manufacture of a three-dimensional, shaped graphite electrode shown in the drawing are those necessary for an understanding of the invention; identical elements in the various figures are provided with identical reference numerals. In particular, supporting and guidance columns, hydraulic or electrical drive assemblies for the work plate and the ram plate, control devices and measuring devices and flushing and filtering devices are not shown further, because they are not of importance to the essence of the invention.

For the sake of a better understanding of the invention, FIGS. 1 and 2 show an apparatus according to the prior art, upon which the invention is based. The apparatus substantially comprises a work plate 1, a ram plate 2 and a shaped file 4. The shaped file 4 is equipped on its back with an adapter plate 14, by way of which the shaped file is secured in a positionally defined manner to the ram plate 2. Many flushing conduits 6 extend from flushing chambers 5 disposed on the back of the adapter plate to the filing surface of the shaped file in such a manner that the flushing conduits have their outlets distributed at least approximately uniformly over the surface of the shaped file. The three-dimensional, shaped electrode blank, of graphite, is secured to the work plate 1, again in a three-dimensionally defined manner, utilizing an adapter plate 15. As a result of the orbital movement of the work plate 1 and the simultaneous continuous lowering of the ram plate 2 and thus of the shaped file 4, a filing effect takes place, in the course of which the shaped file removes graphite from the shaped electrode blank. The resultant small graphite particles in the machining zone, that is, in the working gap 7, are transported out of the working gap 7 between the shaped file 4 and the three-dimensional, shaped electrode blank by means of a flushing fluid, which exits in shower-like fashion from the flushing conduits 6 in the course of the filing process. The ram plate 2 periodically executes a reciprocating movement a few millimeters in length in order to reinforce the outward transportation of the graphite particles. The flushing fluid containing the graphite particles flows off to the outside at the sides.

It has been found that in this known method of operation, in particular in manufacturing shapes that are heavily ribbed, it is not always possible to remove the filed graphite particles to the required extent; the formation of sticky buildup can thus occur, as is indicated at 9 in FIG. 1. If this buildup is not noticed in time and the shaped file is remachined or in other words resharpened at these points, the result may be breakage of the file or the electrode. A probable contributing factor to the creation of these points of sticky buildup is that the working gap 7, when the ram plate 2 is periodically raised, is not sufficiently well supplied with flushing fluid, causing the formation of air bubbles at one point or another, as indicated at 8 in FIGS. 1 and 2. In the illustrated exemplary embodiment, what is shown is the stage in which the three-dimensional, shaped electrode 3 has at least approximately assumed its final shape.

The schematically illustrated apparatus according to the invention which is shown in FIGS. 3 and 4 agrees to a great extent with the prior art. In particular, the drive, control and measuring assemblies which are not shown correspond to those of the prior art. Deviating from the prior art described thus far, it is not the three-dimensional, shaped electrode blank but the shaped file 4 which is secured to the work plate 1, and the three-dimensional, shaped electrode blank or the three-dimensional, shaped graphite electrode 3 is secured to the ram plate 2 disposed above the working plate. The shaped file, when it was manufactured, was embodied as a pan; that is, it was provided with an outer wall 10 pointing upward and extending all around the file in the manner of a pan. The upper rim 12 of this outer wall is located higher than the highest point 11 on the contour of the shaped file 4. A flushing conduit 6 communicating with a flushing chamber 5 discharges at the lowest point 13 of the contour of the shaped file 4. The diameter of this flushing conduit is somewhat larger, for instance from two to five times as large, as compared with the diameter of the flushing conduits of the prior art. In the case of very complicated shapes, a plurality of flushing conduits may if required be disposed distributed over the surface, instead of only one flushing conduit. The number of flushing conduits required at a maximum is very low in comparison with the number of flushing conduits in the prior art. For purposes of comparison, instead of the previously required 120 flushing conduits, only 3 flushing conduits were required for the manufacture of the same three-dimensional, shaped electrode.

The upwardly extended, pan-like outer wall 10 assures that flushing fluid is continuously present in the entire working gap 7, even at the times when the ram plate 2 is periodically raised, as is seen clearly in FIG. 4. It is not possible for air bubbles to form during this operation. As a result, the three-dimensional, shaped electrode 3 and the shaped file 4 are continuously and intensively cleaned over the entire working gap. As a result of the laterally closed chambers of the shaped file 4, an additional pumping action is achieved when the ram plate 2 is raised and lowered. Because of the alternating suction and pressure movement, the graphite dust, which does not combine with the flushing fluid, is reliably and effortlessly floated out of the working gap 7 and moved outward over the pan-like rim of the shaped file. On account of the pan-like embodiment of the shaped file 4 and its mounting on the lower work plate 1, the flushing fluid introduced into the working gap is no longer capable of simply flowing downward and out. Instead, it has to rise up over the more highly placed pan-like rim before it can reach the outside. A certain buildup of pressure accordingly takes place in the working gap 7, as a result of which filed graphite particles are uninterruptedly removed, even at points in the machining zone which are unfavorably located. Furthermore, no turbulence in the flow of flushing fluid occurs at all, because the number of flushing conduits required is so low.

The development of points of sticky buildup is virtually eliminated. The shaped file therefore remains uniformly sharp over its entire filing surface, so that substantially better filing action is attained. Because of the elimination of the sticky points, excessively high pressures no longer build up, even partially, within the working gap. With the danger of breakage thus reduced, it is thus possible, using the apparatus according to the invention, to file three-dimensional, shaped electrodes with thinner ribs and thinner crossbars.

The apparatus according to the invention not only has the substantial advantage that the shaped file remains uniformly sharp because of the elimination of sticky buildup and therefore better filing action, among other effects, is attained; the expense for manufacturing the shaped file is likewise reduced decisively, because only a practically negligibly small number of flushing conduits is now required—in the ideal case, only single flushing conduit. The result is a substantial reduction in time. In order to manufacture an average shaped file having a size of about 350×350 mm, in which approximately 120 flushing conduits would have to be provided according to the prior art but only 3 flushing conduits according to the invention, only about half the previously usual time is now required.

A further advantage is attained because, on account of the smaller number of flushing conduits still required, it also becomes possible to utilize steel pattern molds, which may already exist, directly for manufacturing the required shaped file. The use of such steel molds for manufacturing shaped files was not possible previously. In fact it was previously necessary to provide the mold from which the shaped file was made with a correspondingly large number of bores in order to produce the many flushing conduits. It was therefore necessary, in the known method, first to make a negative casting and then a positive casting from it, for instance in plastic.

I claim:

1. Apparatus for the manufacture of a three-dimensional, shaped graphite electrode from a graphite electrode block or blank (3) having a three-dimensional shaped file formed with an abrasive surface, in which the file (4) and the three-dimensional block or blank (3) are moved translationally toward one another and carry out a filing stroke, while executing planetary relative orbital movement in a plane between the shaped file and the three-dimensional electrode block or blank until the contour of the electrode block or blank is three-dimensional, shaped to correspond, with tolerance, to a negative copy of the contour of the shaped file;

a support plate (1), the three-dimensional, shaped file being secured to the support plate;

wherein the shaped file and the three-dimensional, shaped electrode additionally, periodically, execute a reciprocating movement toward and away from one another, the space between the file and the electrode during said reciprocating movement defining a working gap;

a flushing fluid is provided, for flushing out electrode material filed away by the shaped file from the working gap between the shaped file and the three-dimensional, shaped electrode block or blank (3);

and wherein at least one flushing conduit is formed in the shaped file, terminating in the working gap, to permit introduction of the flushing fluid thereinto, wherein, in accordance with the invention, the shaped electrode blank is disposed above the shaped file (4);

and the shaped file, below or beneath the electrode block or blank, includes an outer wall (10) extending upwardly, with respect to the support plate, and surrounding the electrode block in pan-like fashion, the upper rim (12) of the wall (10) of the shaped file being at a higher level than the highest point (11) of the contour of the shaped file (4) with respect to the support plate.

2. Apparatus according to claim 1, wherein one flushing conduit discharges at least approximately at the lowest point (13) of the contour of the shaped file (4) with respect to said support plate.

3. Apparatus according to claim 1, wherein only one flushing conduit is provided, terminating in said gap.

4. Apparatus according to claim 1, wherein only one flushing conduit is provided, said single or only flushing conduit discharging at least approximately at the lowest point (13) of the contour of the shaped file (4) with respect to the support plate.

5. A three-dimensional, shaped file for manufacturing a three-dimensional, shaped graphite electrode, said file having at least one flushing conduit discharging at the filing surface, for flushing away graphite particles arising, in operation of the shaped file, in a working gap between the shaped filed and the three-dimensional electrode, wherein, in accordance with the invention, the shaped file (4) includes an outer wall (10) extending upwardly and surrounding the shaped file in pan-like fashion, the upper rim (12) of the wall of the shaped file being at a higher level than the highest point (11) of the contour of the shaped file;

and a flushing conduit (6) being formed in the shaped file terminating at least approximately at the lowest point (13) of the contour of the shaped file.

6. File according to claim 5, wherein only a few flushing conduits (6) are provided, one of which flushing conduits discharge at least approximately at the lowest point (13) of the contour of the shaped file.

7. File according to claim 5, wherein only one flushing conduit is provided, said single flushing conduit discharging at least approximately at the lowest point (13) of the contour of the shaped file.

8. A method for the manufacture of a three-dimensional, shaped graphite electrode from a graphite electrode blank or block (3) comprising moving a three-dimensional, shaped file with an abrasive surface translationally toward the block to carry out a filing stroke, while executing a planetary relative orbital movement in a plane, between the shaped file and the electrode block or blank until the contour of the electrode block or blank is three-dimensionally shaped to correspond, with tolerance, to a negative copy of the contour of the shaped file;

additionally periodically moving the shaped file and the three-dimensional, shaped block toward and away from one another, the space between the file and the electrode block, during said reciprocating movement, defining a working gap;

introducing a flushing fluid for flushing out material filed away by the shaped file from the working gap between the shaped file and the three-dimensional shaped electrode block, wherein said step of introducing the flushing fluid into the gap comprises introducing the flushing fluid into the working gap (7) at least approximately at the lowest point (13) of the contour of the shaped file;

and removing the flushing fluid from the gap at a level which is higher than the highest point of the contour of the shaped file.

9. Method according to claim 8, wherein the step of removing the flushing fluid, with abraded electrode material filed away by the shaped file, comprises providing an upwardly extending outer wall around the shaped file, said outer wall executing said planetary movements;

and passing the flushing fluid, laden with abraded electrode material, over the upper rim of said outer wall.

10. Method according to claim 8, wherein the step of relatively moving the three-dimensional, shaped file and the three-dimensional graphite electrode block comprises moving the shaped file at a position beneath or below the shaped graphite block, and supporting the shaped file beneath the graphite block.

11. Method according to claim 8, wherein said step of introducing flushing fluid into the gap comprises introducing flushing fluid at the lowest point (13) of the contour of the shaped file only.

12. Method according to claim 8, wherein said step of introducing flushing fluid onto the gap comprises introducing flushing fluid at the lowest point (13) of the contour of the shaped file and through only a few selected flushing conduits passing through the shaped file and discharging flushing fluid into said gap.

* * * * *